US006658857B1

(12) United States Patent
George

(10) Patent No.: US 6,658,857 B1
(45) Date of Patent: Dec. 9, 2003

(54) PORTABLE THERMOELECTRIC COOLING AND HEATING APPLIANCE DEVICE AND METHOD OF USING

(76) Inventor: Hatho M. George, 136-43 Hookcreek Blvd., Rosedale, NY (US) 11216

( * ) Notice: Subject to any disclaimer, the term of this patent is extended or adjusted under 35 U.S.C. 154(b) by 0 days.

(21) Appl. No.: 10/369,481

(22) Filed: Feb. 20, 2003

(51) Int. Cl.[7] ..... F25B 21/02; F25B 21/00; F25D 3/00; F28F 13/12; F28F 7/00

(52) U.S. Cl. ..... 62/3.3; 62/3.1; 62/3.2; 62/3.6; 62/3.7; 62/457.1; 62/457.9; 361/967; 165/80.3; 165/121; 165/122; 165/123

(58) Field of Search ..... 62/3.1–3.7, 371, 62/457.1, 457.9, 911; 361/967; 165/80.3, 121, 122, 123

(56) References Cited

U.S. PATENT DOCUMENTS

| | | | | | |
|---|---|---|---|---|---|
| 5,035,122 | A | * | 7/1991 | Oogjen | 62/457.2 |
| 5,301,508 | A | * | 4/1994 | Kahl et al. | 62/3.62 |
| 5,319,937 | A | * | 6/1994 | Fritsch et al. | 62/3.62 |
| 5,603,220 | A | * | 2/1997 | Seaman | 62/3.7 |
| 6,260,360 | B1 | * | 7/2001 | Wheeler | 62/3.6 |
| 6,301,901 | B1 | * | 10/2001 | Coffee et al. | 62/3.7 |

* cited by examiner

*Primary Examiner*—William C. Doerrler
*Assistant Examiner*—Filip Zec

(57) ABSTRACT

A portable thermoelectric cooling and heating appliance device and associated method of using the device are disclosed. The device comprises: a generally rectangular box, a hinge, a generally rectangular lid, a locking means, and a power cord. The box has a divider wall which defines a partition between a left and a right chamber within the box. The box further includes: an outer shell; an insulation layer; a inner shell; a power input plug; a first heat transfer unit; a first network of cooling/heating coils; a first control knob having a first voltage regulator and a first thermostat operationally connected to each other; a first spigot having a first button and a first drain; a second heat transfer unit; a second network of cooling/heating coils; a second control knob having a second voltage regulator and a second thermostat operationally connected to each other; and a second spigot having a second button and a second drain. The hinge is attached to the outer shell of the box. The lid is dimensioned to substantially fit over the top of the box, in which the lid is attached to the hinge, whereby the lid is pivotally attached to the box. The locking means is for locking together the lid to the box, in which a first portion of the locking means is attached to the box, and a second portion of the locking means is attached to the lid. The power cord has a first socket end and a second socket end, in which the first socket end is operationally connectable to the power inlet plug of the box, and the second socket end is operationally connectable to a standard cigarette lighter power output in an automobile. The method of using the device comprises the steps of adjoining, affixing, allowing, closing, disconnecting, grabbing, inserting, letting, lowering, obtaining, placing, positioning, pressing, pulling, pushing, raising, removing, setting, taking, turning, and unplugging.

20 Claims, 6 Drawing Sheets

PORTABLE THERMOELECTRIC COOLING AND HEATING APPLIANCE DEVICE AND METHOD OF USING

FIELD OF THE INVENTION

The present invention relates containers, more particularly, to a portable thermoelectric cooling and heating appliance device and associated method of using the device.

DESCRIPTION OF THE PRIOR ART

In today's modern times, the commuter times are getting longer, and various other automobile road trips are also getting longer. As a consequence, the motorist often finds a need for both heating food and chilling beverages within the automobile. A wide variety of portable thermoelectric cooling and heating appliance devices is currently available on the commercial market and an even larger number of these types of devices are known in the art of portable thermoelectric cooling and heating appliance devices, for example, the portable heating and cooling appliance disclosed by Munz and Collins in U.S. Pat. No. 3,111,166; the portable battery operated hot-cold storage unit disclosed by Pullens in U.S. Pat. No. 4,027,727; the vehicle thermoelectric cooling and heating food and drink appliance disclosed by Trachtenberg and Trachtenberg in U.S. Pat. No. 4,759,190; the portable beverage dispenser disclosed by Forrester in U.S. Pat. No. 4,913,318; the portable electric water heater for outdoor use disclosed by Alston and Cattron in U.S. Pat. No. 4,947,025; and the thermoelectric container disclosed by Kahl and Taylor in U.S. Pat. No. D350,048.

While all of the above-described devices fulfill their respective, particular objectives and requirements, the aforementioned patents do not describe a portable thermoelectric cooling and heating appliance device having a generally rectangular box, a hinge, a generally rectangular lid, a locking means, and a power cord, in which the box has a divider wall which defines a partition between a left and a right chamber within the box, wherein the box further includes: an outer shell; an insulation layer; a inner shell; a power input plug; a first heat transfer unit; a first network of cooling/heating coils; a first control knob having a first voltage regulator and a first thermostat operationally connected to each other; a first spigot having a first button and a first drain; a second heat transfer unit; a second network of cooling/heating coils; a second control knob 28 having a second voltage regulator and a second thermostat operationally connected to each other; and a second spigot having a second button and a second drain. This combination of elements would specifically match the user's particular individual needs of making it possible to to use the device in the method comprising the steps of adjoining, affixing, allowing, closing, disconnecting, grabbing, inserting, letting, lowering, obtaining, placing, positioning, pressing, pulling, pushing, raising, removing, setting, taking, turning, and unplugging. The above-described patents make no provision for a portable thermoelectric cooling and heating appliance device having a generally rectangular box, a hinge, a generally rectangular lid, a locking means, and a power cord, in which the box has a divider wall which defines a partition between a left and a right chamber within the box, wherein the box further includes: an outer shell; an insulation layer; a inner shell; a power input plug; a first heat transfer unit; a first network of cooling/heating coils; a first control knob having a first voltage regulator and a first thermostat operationally connected to each other; a first spigot having a first button and a first drain; a second heat transfer unit; a second network of cooling/heating coils; a second control knob 28 having a second voltage regulator and a second thermostat operationally connected to each other; and a second spigot having a second button and a second drain.

Therefore, a need exists for a new and improved portable thermoelectric cooling and heating appliance device having a generally rectangular box, a hinge, a generally rectangular lid, a locking means, and a power cord, in which the box has a divider wall which defines a partition between a left and a right chamber within the box, wherein the box further includes: an outer shell; an insulation layer; a inner shell; a power input plug; a first heat transfer unit; a first network of cooling/heating coils; a first control knob having a first voltage regulator and a first thermostat operationally connected to each other; a first spigot having a first button and a first drain; a second heat transfer unit; a second network of cooling/heating coils; a second control knob 28 having a second voltage regulator and a second thermostat operationally connected to each other; and a second spigot having a second button and a second drain. In this respect, the portable thermoelectric cooling and heating appliance device according to the present invention substantially departs from the conventional concepts and designs of the prior art, and in doing so provides an apparatus primarily developed for the purpose of providing a means for making it possible to use the device in the method comprising the steps of adjoining, affixing, allowing, closing, disconnecting, grabbing, inserting, letting, lowering, obtaining, placing, positioning, pressing, pulling, pushing, raising, removing, setting, taking, turning, and unplugging.

SUMMARY OF THE INVENTION

The present device and method of using, according to the principles of the present invention, overcomes the shortcomings of the prior art by providing a portable thermoelectric cooling and heating appliance device and method of using are disclosed. The device comprises: a generally rectangular box, a hinge, a generally rectangular lid, a locking means, and a power cord. The box has a divider wall which defines a partition between a left and a right chamber within the box. The box further includes: an outer shell; an insulation layer; a inner shell; a power input plug; a first heat transfer unit; a first network of cooling/heating coils; a first control knob having a first voltage regulator and a first thermostat operationally connected to each other; a first spigot having a first button and a first drain; a second heat transfer unit; a second network of cooling/heating coils; a second control knob having a second voltage regulator and a second thermostat operationally connected to each other; and a second spigot having a second button and a second drain. The hinge is attached to the outer shell of the box. The lid is dimensioned to substantially fit over the top of the box, in which the lid is attached to the hinge, whereby the lid is pivotally attached to the box. The locking means is for locking together the lid to the box, in which a first portion of the locking means is attached to the box, and a second portion of the locking means is attached to the lid. The power cord has a first socket end and a second socket end, in which the first socket end is operationally connectable to the power inlet plug of the box, and the second socket end is operationally connectable to a standard cigarette lighter power output in an automobile. The method of using the device comprises the steps of adjoining, affixing, allowing, closing, disconnecting, grabbing, inserting, letting, lowering, obtaining, placing, positioning, pressing, pulling, pushing, raising, removing, setting, taking, turning, and unplugging.

In view of the foregoing disadvantages inherent in the known type portable thermoelectric cooling and heating appliance devices now present in the prior art, the present invention provides an improved portable thermoelectric cooling and heating appliance device, which will be described subsequently in great detail, is to provide a new and improved portable thermoelectric cooling and heating appliance device which is not anticipated, rendered obvious, suggested, or even implied by the prior art, either alone or in any combination thereof.

To attain this, the present invention essentially comprises a generally rectangular box, a hinge, a generally rectangular lid, a locking means, and a power cord. The box has a divider wall which defines a partition between a left and a right chamber within the box. The box further includes: an outer shell; an insulation layer; a inner shell; a power input plug; a first heat transfer unit; a first network of cooling/heating coils; a first control knob having a first voltage regulator and a first thermostat operationally connected to each other; a first spigot having a first button and a first drain; a second heat transfer unit; a second network of cooling/heating coils; a second control knob 28 having a second voltage regulator and a second thermostat operationally connected to each other; and a second spigot having a second button and a second drain. The hinge is attached to the outer shell of the box. The lid is dimensioned to substantially fit over the top of the box, in which the lid is attached to the hinge, whereby the lid is pivotally attached to the box. The locking means is for locking together the lid to the box, in which a first portion of the locking means is attached to the box, and a second portion of the locking means is attached to the lid. The power cord has a first socket end and a second socket end, in which the first socket end is operationally connectable to the power inlet plug of the box, and the second socket end is operationally connectable to a standard cigarette lighter power output in an automobile.

There has thus been outlined, rather broadly, the more important features of the invention in order that the detailed description thereof that follows may be better understood, and in order that the present contribution of the art may be better appreciated.

The invention may also include a gasket attached to the top of the box. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable thermoelectric cooling and heating appliance device that has all the advantages of the prior art portable thermoelectric cooling and heating appliance device and none of the disadvantages.

It is another object of the present invention to provide a new and improved portable thermoelectric cooling and heating appliance device that may be easily and efficiently manufactured and marketed.

An even further object of the present invention is to provide a new and improved portable thermoelectric cooling and heating appliance device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new portable thermoelectric cooling and heating appliance device that provides in the apparatuses and methods of the prior art some of the advantages thererof, while simultaneously overcoming some of the disadvantages normally associated therewith.

Even still another object of the present invention is to provide a portable thermoelectric cooling and heating appliance device having a generally rectangular box, a hinge, a generally rectangular lid, a locking means, and a power cord, in which the box has a divider wall which defines a partition between a left and a right chamber within the box, wherein the box further includes: an outer shell; an insulation layer; a inner shell; a power input plug; a first heat transfer unit; a first network of cooling/heating coils; a first control knob having a first voltage regulator and a first thermostat operationally connected to each other; a first spigot having a first button and a first drain; a second heat transfer unit; a second network of cooling/heating coils; a second control knob 28 having a second voltage regulator and a second thermostat operationally connected to each other; and a second spigot having a second button and a second drain, wherein the hinge is attached to the outer shell of the box; wherein the lid is dimensioned to substantially fit over the top of the box, in which the lid is attached to the hinge, whereby the lid is pivotally attached to the box; wherein the locking means is for locking together the lid to the box, in which a first portion of the locking means is attached to the box, and a second portion of the locking means is attached to the lid; and wherein the power cord has a first socket end and a second socket end, in which the first socket end is operationally connectable to the power inlet plug of the box, and the second socket end is operationally connectable to a standard cigarette lighter power output in an automobile. This combination of elements makes it possible to use the device in the method comprising the steps of adjoining, affixing, allowing, closing, disconnecting, grabbing, inserting, letting, lowering, obtaining, placing, positioning, pressing, pulling, pushing, raising, removing, setting, taking, turning, and unplugging.

Lastly, it is an object of the present invention to provide a new and improved method of using comprising the steps of adjoining, affixing, allowing, closing, disconnecting, grabbing, inserting, letting, lowering, obtaining, placing, positioning, pressing, pulling, pushing, raising, removing, setting, taking, turning, and unplugging.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
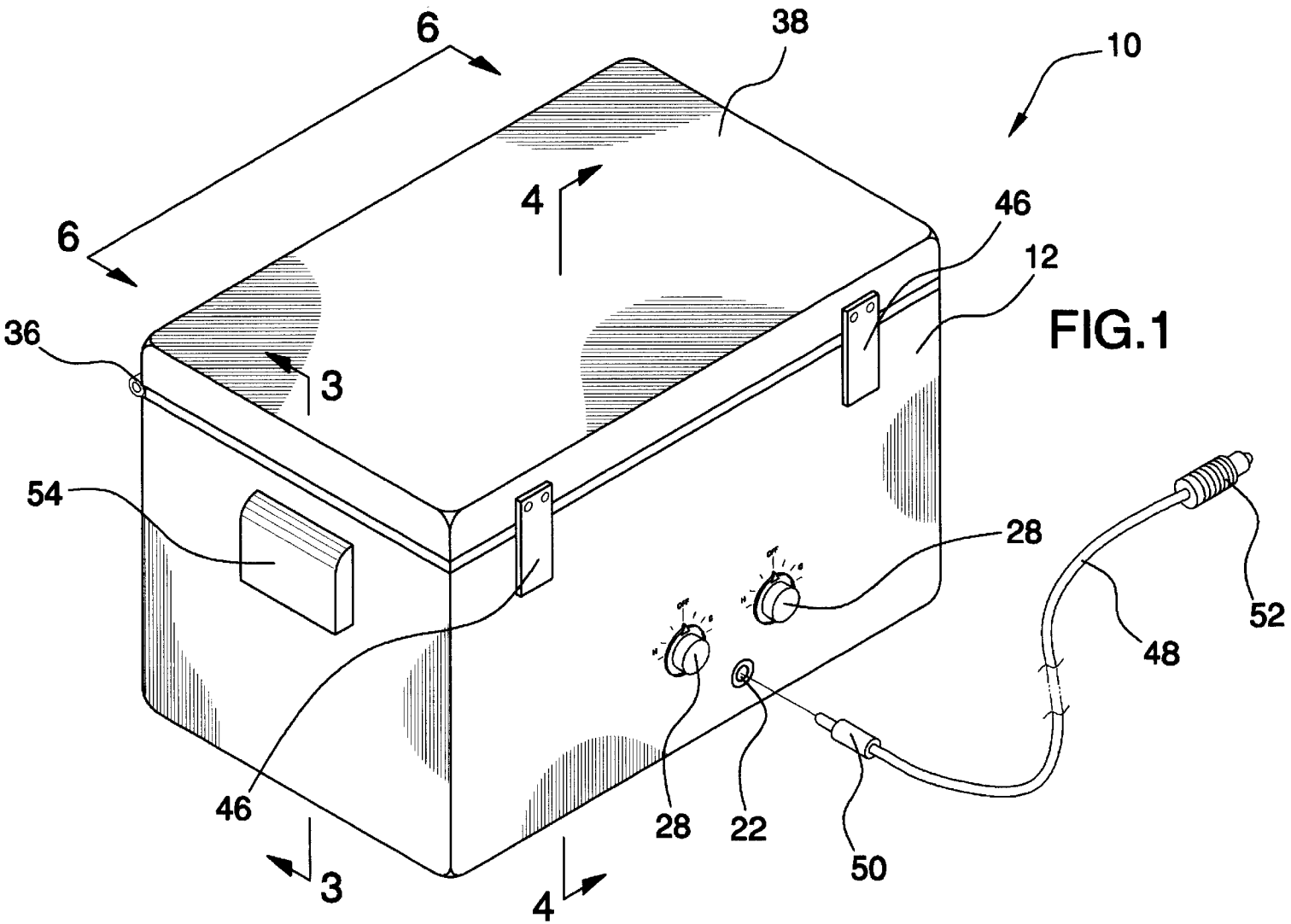
FIG. 1 is a perspective view of a preferred embodiment of the portable thermoelectric cooling and heating appliance device in the closed position constructed in accordance with the principles of the present invention.

Referring now to the drawings, and in particular FIGS. 1 to 6 thereof, one preferred embodiment of the present invention is shown and generally designated by the reference numeral 10. One preferred embodiment of a portable thermoelectric cooling and heating appliance device 10, the device 10 comprising: a generally rectangular box 12, a hinge 36, a generally rectangular lid 38, a locking means 46, and a power cord 48. The box 12 has a top, four sides, a bottom and a divider wall 14, in which the divider wall 14 defines a partition between a left and a right chamber of the box 12. The box 12 includes: an outer shell 16; an insulation layer 18 attached to the outer shell 16; a inner shell 20 attached to the insulation layer 18; a power input plug 22; a first heat transfer unit 24 attached to the left chamber of the box 12, the first heat transfer unit 24 electrically connected to the power input plug 22; a first network of cooling/heating coils 26 attached to the left chamber of the box 12, the first network of cooling/heating coils 26 operatively attached to the first heat transfer unit 24; a first control knob 28 having a first voltage regulator and a first thermostat operationally connected to each other, the first control knob 28 attached to the left chamber of the box 12, the first control knob 28 operatively attached to the first heat transfer unit 24; a first spigot 30 having a first button 32 and a first drain 34, the first spigot 30 attached to the left chamber of the box 12 and extending outwardly from the box 12, when the first button 32 of the first spigot 30 is depressed then the first drain 34 is fluidly connected between the left chamber of the box 12 with a surrounding area outside of the device 10, when the first button 32 is release and not depressed then the first drain 34 is not fluidly connected between the left chamber of the box 12 with the surrounding area outside of the device 10; a second heat transfer unit 24 attached to the right chamber of the box 12, the second heat transfer unit 24 electrically connected to the power input plug 22; a second network of cooling/heating coils 26 attached to the right chamber of the box 12, the second network of cooling/heating coils 26 operatively attached to the second heat transfer unit 24; a second control knob 28 having a second voltage regulator and a second thermostat operationally connected to each other, the second control knob 28 attached to the right chamber of the box 12, the second control knob 28 operatively attached to the second heat transfer unit 24; and a second spigot 30 having a second button 32 and a second drain 34, the second spigot 30 attached to the right chamber of the box 12 and extending outwardly from the box 12, when the second button 32 of the second spigot 30 is depressed then the second drain 34 is fluidly connected between the right chamber of the box 12 with the surrounding area outside of the device 10, when the second button 32 is release and not depressed then the second drain 34 is not fluidly connected between the right chamber of the box 12 with the surrounding area outside of the device 10. The hinge 36 is attached to the outer shell 16 of the box 12. The lid 38 is dimensioned to substantially fit over the top of the box 12, in which the lid 38 is attached to the hinge 36, wherein the lid 38 is pivotally attached to the box 12. When the lid 38 is pivoted over the top of the box 12 then the device 10 is in a closed position. When the lid 38 is pivoted away from the top of the box 12 then the device 10 is in an open position. The lid 38 includes: an exterior shell 40; an insulation lining 42 attached to the exterior shell 40 of the lid 38; and an interior shell 44 attached to the insulation lining 42 of the lid 38. The locking means is for locking together the lid 38 to the box 12, in which a first portion of the locking means 46 is attached to the box 12, and a second portion of the locking means 46 is attached to the lid 38. The power cord 48 has a first socket end 50 and a second socket end 52, in which the first socket end 50 is operationally connectable to the power inlet plug 22 of the box 12, and the second socket end 52 is operationally connectable to a standard cigarette lighter power output in an automobile.

An optional handle 54 may be added to the device 10. One preferred configuration of the handle 54 is that it is attached to the outer shell 16 of the box 12. Another preferred configuration of the handle 54 is that it is attached to the exterior shell 40 of the lid 38.

An optional rubber gasket 56 may be added to the device 10. One preferred configuration is that the rubber gasket 56 is attached to the top of top of the box 12.

The locking means 46 may be may commercially available means for locking together two components together.

One preferred configuration is that the locking means 46 comprises a latch pivotally attached to the exterior shell 40 of the lid 38; and a coupling pin attached to the outer shell 16 of the box 12, wherein the latch and the coupling pin are coupleable together, when the box 12 is in the closed position and when the latch is pivoted towards the coupling pin then the locking means 46 is in a locked mode, when the box 12 is in the closed position and when the latch is pivoted away from the coupling pin then the locking means 46 is in an open mode. Another preferred configuration of the locking means 46 comprising: a first fabric swath having a first exposed contact surface, the first fabric swath is attached to the exterior shell 40 of the lid 38; and a second fabric swath having a second exposed contact surface, the second fabric swath is attached to the outer shell 16 of the box 12, wherein the first exposed contact surface of the first fabric swath and second exposed contact surface of the second fabric swath are interconnectable, when the box 12 is in the closed position and when the first fabric swath is pivoted towards the second fabric swath so that the first exposed contact surface of the first fabric swath interconnects with the second exposed contact surface of the second fabric swath then the locking means 46 is in a locked mode, when the box 12 is in the closed position and when the first fabric swath is pivoted away from the second fabric swath so that the first exposed contact surface of the first fabric swath does not interconnect with the second exposed contact surface of the second fabric swath then the locking means 46 is in an open mode. One configuration of the first contact surface of the first fabric swath comprises a plurality of minuscule hooks extending outwardly from the first contact surface of the first fabric swath; and wherein the second contact surface of the second fabric swath comprises a plurality of minuscule loops extending outwardly from the second contact surface of the second fabric swath. Another preferred configuration of the first contact surface of the first fabric swath comprises a plurality of minuscule loops extending outwardly from the first contact surface of the first fabric swath; and wherein the second contact surface of the second fabric swath comprises a plurality of minuscule hooks extending outwardly from the second contact surface of the second fabric swath.

The inner shell 20 of the box 12 is may be made of any sturdy material. One preferred configuration of the inner shell 20 of the box 12 is that it is made of aluminum.

The insulation layer 18 of the box 12 may be made of any insulative material. One preferred configuration of the insulation layer 18 of the box 12 is that it is made of foam insulation.

The outer shell 16 of the box 12 may be made of any sturdy material. One preferred configuration of the outer shell 16 of the box 12 is that it is made of plastic, wherein the plastic is selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The exterior shell 40 of the lid 38 may be made of any sturdy material. One preferred configuration of the exterior shell 40 of the lid 38 is that is made of aluminum.

The insulation lining 42 of the lid 38 may be made of any insulative material. One preferred configuration of the insulation lining 42 of the lid 38 is that it is made of foam insulation.

The interior shell 44 of the lid 38 may be made of any sturdy material. One preferred configuration of the interior shell 44 of the lid 38 is that it is made of plastic, wherein the plastic is selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The hinge 36 may be any commercially available type of hinge 36. One preferred configuration of the hinge 36 is that it comprises an elongated piano hinge 36.

The heat transfer unit 24 may comprise any commercially heat transfer units 24. One preferred configuration is that the heat transfer unit 24 comprises a Peltier heat transfer unit 24.

Another preferred embodiment of the portable thermoelectric cooling and heating appliance device 10 consist essentially of: a generally rectangular box 12 having a top, four sides, a bottom and a divider wall 14, the divider wall 14 defining a partition between a first and a right chamber of the box 12, the box 12 including: an outer shell 16, the outer shell 16 of the box 12 is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof; an insulation layer 18 attached to the outer shell 16, wherein the insulation layer 18 of the box 12 is made of foam insulation; a inner shell 20 attached to the insulation layer 18, wherein the inner shell 20 of the box 12 is made of aluminum; a power input plug 22; a first heat transfer unit 24 attached to the left chamber of the box 12, the first heat transfer unit 24 electrically connected to the power input plug 22, wherein the first heat transfer unit 24 comprises a peltier heat transfer unit 24; a first network of cooling/heating coils 26 attached to the left chamber of the box 12, the first network of cooling/heating coils 26 operatively attached to the first heat transfer unit 24; a first control knob 28 having a first voltage regulator and a first thermostat operationally connected to each other, the first control knob 28 attached to the left chamber of the box 12, the first control knob 28 operatively attached to the first heat transfer unit 24; a first spigot 30 having a first button 32 and a first drain 34, the first spigot 30 attached to the left chamber of the box 12 and extending outwardly from the box 12, when the first button 32 of the first spigot 30 is depressed then the first drain 34 is fluidly connected between the left chamber of the box 12 with a surrounding area outside of the device 10, when the first button 32 is release and not depressed then the first drain 34 is not fluidly connected between the left chamber of the box 12 with the surrounding area outside of the device 10; a second heat transfer unit 24 attached to the right chamber of the box 12, the second heat transfer unit 24 electrically connected to the power input plug 22, wherein the second heat transfer unit 24 comprises a peltier heat transfer unit 24; a second network of cooling/heating coils 26 attached to the right chamber of the box 12, the second network of cooling/heating coils 26 operatively attached to the second heat transfer unit 24; a second control knob 28 having a second voltage regulator and a second thermostat operationally connected to each other, the second control knob 28 attached to the right chamber of the box 12, the second control knob 28 operatively attached to the second heat transfer unit 24; a second spigot 30 having a second button 32 and a second drain 34, the second spigot 30 attached to the right chamber of the box 12 and extending outwardly from the box 12, when the second button 32 of the second spigot 30 is depressed then the second drain 34 is fluidly connected between the right chamber of the box 12 with the surrounding area outside of the device 10, when the second button 32 is release and not depressed then the second drain 34 is not fluidly connected between the right chamber of the box 12 with the surrounding area outside of the device 10; and a handle 54 attached to the outer shell 16 of the box 12; a hinge 36 attached to the outer shell 16 of the box 12, wherein the hinge 36 comprises an elongated piano hinge 36; a generally rectangular lid 38 dimensioned to substantially fit over the top of the box 12, the lid 38 attached to the hinge 36, wherein the lid 38 is pivotally attached to the box 12, when the lid 38 is pivoted over the top of the box 12 then the device 10 is in a closed position, when the lid 38 is pivoted away from the top of the box 12 then the device 10 is in an open position, the lid 38 including: an exterior shell 40, wherein the exterior shell 40 of the lid 38 is made of aluminum; an insulation lining 42 attached to the exterior shell 40 of the lid 38, wherein the insulation lining 42 of the lid 38 is made of foam insulation; an interior shell 44 attached to the insulation lining 42 of the lid 38, wherein the interior shell 44 of the lid 38 is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof; a means for locking together the lid 38 to the box 12, a first portion of the locking means 46 is attached to the box 12, and a second portion of the locking means 46 is attached to the lid 38, wherein the locking means 46 comprising: a first fabric swath having a first exposed contact surface, the first fabric swath is attached to the exterior shell 40 of the lid 38; and a second fabric swath having a second exposed contact surface, the second fabric swath is attached to the outer shell 16 of the box 12, wherein the first exposed contact surface of the first fabric swath and second exposed contact surface of the second fabric swath are interconnectable together, when the box 12 is in the closed position and when the first fabric swath is pivoted towards the second fabric swath so that the first exposed contact surface of the first fabric swath interconnects with the second exposed contact surface of the second fabric swath then the locking means 46 is in a locked mode, when the box 12 is in the closed position and when the first fabric swath is pivoted away from the second fabric swath so that the first exposed contact surface of the first fabric swath does not interconnect with the second exposed contact surface of the second fabric swath then the locking means 46 is in an open mode, wherein the first contact surface of the first fabric swath comprises a plurality of minuscule hooks extending outwardly from the first contact surface of the first fabric swath; and wherein the second contact surface of the second fabric swath comprises a plurality of minuscule loops extending outwardly from the second contact surface of the second fabric swath; and a power cord 48 having a first socket end 50 and a second socket end 52, the first socket end 50 is operationally connectable to the power inlet plug 22 of the box 12, the second socket end 52 is operationally connectable to a standard cigarette lighter power output in an automobile.

One preferred embodiment of a method of using a portable thermoelectric cooling and heating appliance device 10, the method comprising the steps of: adjoining, affixing, allowing, closing, disconnecting, grabbing, inserting, letting, lowering, obtaining, placing, positioning, pressing, pulling, pushing, raising, removing, setting, taking, turning, and unplugging. The obtaining step comprises obtaining the device 10 comprising: a generally rectangular box 12 having a top, four sides, a bottom and a divider wall 14, the divider wall 14 defining a partition between a left and a right chamber of the box 12, the box 12 including: an outer shell 16, the outer shell 16 of the box 12 is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof; an insulation layer 18 attached to the outer shell 16, wherein the insulation layer 18 of the box 12 is made of foam insulation; a inner shell 20 attached to the insulation layer 18, wherein the inner shell 20 of the box 12 is made of aluminum; a power input plug 22; a first heat transfer unit 24 attached to the left chamber of the box 12, the first heat transfer unit 24 electrically connected to the power input plug 22, wherein the first heat transfer unit 24 comprises a peltier heat transfer unit 24; a first network of cooling/heating coils 26 attached to the left chamber of the box 12, the first network of cooling/heating coils 26 operatively attached to the first heat transfer unit 24; a first control knob 28 having a first voltage regulator and a first thermostat operationally connected to each other, the first control knob 28 attached to the left chamber of the box 12, the first control knob 28 operatively attached to the first heat transfer unit 24; a first spigot 30 having a first button 32 and a first drain 34, the first spigot 30 attached to the left chamber of the box 12 and extending outwardly from the box 12, when the first button 32 of the first spigot 30 is depressed then the first drain 34 is fluidly connected between the left chamber of the box 12 with a surrounding area outside of the device 10, when the first button 32 is release and not depressed then the first drain 34 is not fluidly connected between the left chamber of the box 12 with the surrounding area outside of the device 10; a second heat transfer unit 24 attached to the right chamber of the box 12, the second heat transfer unit 24 electrically connected to the power input plug 22, wherein the second heat transfer unit 24 comprises a peltier heat transfer unit 24; a second network of cooling/heating coils 26 attached to the right chamber of the box 12, the second network of cooling/heating coils 26 operatively attached to the second heat transfer unit 24; a second control knob 28 having a second voltage regulator and a second thermostat operationally connected to each other, the second control knob 28 attached to the right chamber of the box 12, the second control knob 28 operatively attached to the second heat transfer unit 24; a second spigot 30 having a second button 32 and a second drain 34, the second spigot 30 attached to the right chamber of the box 12 and extending outwardly from the box 12, when the second button 32 of the second spigot 30 is depressed then the second drain 34 is fluidly connected between the right chamber of the box 12 with the surrounding area outside of the device 10, when the second button 32 is release and not depressed then the second drain 34 is not fluidly connected between the right chamber of the box 12 with the surrounding area outside of the device 10; and a handle 54 attached to the outer shell 16 of the box 12; a hinge 36 attached to the outer shell 16 of the box 12, wherein the hinge 36 comprises an elongated piano hinge 36; a generally rectangular lid 38 dimensioned to substantially fit over the top of the box 12, the lid 38 attached to the hinge 36, wherein the lid 38 is pivotally attached to the box 12, when the lid 38 is pivoted over the top of the box 12 then the device 10 is in a closed position, when the lid 38 is pivoted away from the top of the box 12 then the device 10 is in an open position, the lid 38 including: an exterior shell 40, wherein the exterior shell 40 of the lid 38 is made of aluminum; an insulation lining 42 attached to the exterior shell 40 of the lid 38, wherein the insulation lining 42 of the lid 38 is made of foam insulation; an interior shell 44 attached to the insulation lining 42 of the lid 38, wherein the interior shell 44 of the lid 38 is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof; a means for locking together the lid 38 to the box 12, a first portion of the locking means 46 is attached to the box 12, and a second portion of the locking means 46 is attached to the lid 38, wherein the locking means 46 comprising: a first fabric swath having a first exposed contact surface, the first fabric swath is attached to the exterior shell 40 of the lid 38; and a second fabric swath having a second exposed contact surface, the second fabric swath is attached to the outer shell 16 of the box 12, wherein the first exposed contact surface of the first fabric swath and second exposed contact surface of the second fabric swath are interconnectable together, when the box 12 is in the closed position and when the first fabric swath is pivoted towards the second fabric swath so that the first exposed contact surface of the first fabric swath interconnects with the second exposed contact surface of the second fabric swath then the locking means 46 is in a locked mode, when the box 12 is in the closed position and when the first fabric swath is pivoted away from the second fabric swath so that the first exposed contact surface of the first fabric swath does not interconnect with the second exposed contact surface of the second fabric swath then the locking means 46 is in an open mode, wherein the first contact surface of the first fabric swath comprises a plurality of minuscule hooks extending outwardly from the first contact surface of the first fabric swath; and wherein the second contact surface of the second fabric swath comprises a plurality of minuscule loops extending outwardly from the second contact surface of the second fabric swath; and a power cord 48 having a first socket end 50 and a second socket end 52, the first socket end 50 is operationally connectable to the power inlet plug 22 of the box 12, the second socket end 52 is operationally connectable to a standard cigarette lighter power output in an automobile. The positioning step comprises positioning the device 10 into an area in the automobile. The adjoining step comprises adjoining the second socket end 52 of the power cord 48 into the standard cigarette lighter power outlet in the automobile. The affixing step comprises affixing the first socket end 50 of the power cord 48 into the power input plug 22 of the device 10. The pulling step comprises pulling pivotally upwards the first fabric swatch so that the first exposed contact surface of the first fabric swath does not interconnect with the second exposed contact surface of the second fabric swath whereby the placing the locking means 46 is in the open mode. The raising step comprises raising pivotally the lid 38 away from the top of the box 12 when the locking means 46 is in the open mode, whereby placing the device 10 in the open position. The placing step comprises placing a sandwich into the left chamber of the device 10 when the device 10 is in the open position. The inserting step comprises inserting a can of carbonated soda into the right chamber of the device 10 when the device 10 is in the open position. The closing step comprises closing pivotally the lid 38 onto the top of the box 12, whereby placing the device 10 in the closed position. The lowering step comprises lowering pivotally downwards the first fabric swatch so that the first exposed contact surface of the first fabric swath interconnects with the second exposed contact surface of the second fabric swath when the device 10 is in the closed position, whereby placing the locking means 46 is in the closed mode. The turning step comprises turning the first control knob 28 to enable the first heat transfer unit 24 to warm up the left chamber of the device 10 when the sandwich is placed in the left chamber of the device 10. The setting step comprises setting the second control knob 28 to enable the second heat transfer unit 24 to cool the right chamber of the device 10. The allowing step comprises allowing the placed sandwich to warm up. The removing step comprises removing the warmed up sandwich from the left chamber of the device 10. The letting step comprises letting the inserted can of carbonated soda cool down. The grabbing step comprises grabbing the cooled down can of carbonated soda from the right chamber of the device 10. The disconnecting step comprises disconnecting the second socket end 52 of the power cord 48 from the standard cigarette lighter power outlet in the automobile. The unplugging step comprises unplugging the first socket end 50 of the power cord 48 from the power input plug 22 of the device 10. The taking step comprises taking the device 10 away from the automobile. The pressing step comprises pressing downwardly onto the first button 32 of the first spigot 30 so that the first drain 34 is fluidly connected between the left chamber of the box 12 with the surrounding area outside of the device 10. The pushing step comprises pushing downwardly onto the second button 32 of the second spigot 30 so that the second drain 34 is fluidly connected between the right chamber of the box 12 with the surrounding area outside of the device 10.

Another preferred embodiment of the method consist essentially of the steps of: adjoining, affixing, allowing, closing, disconnecting, grabbing, inserting, letting, lowering, obtaining, placing, positioning, pressing, pulling, pushing, raising, removing, setting, taking, turning, and unplugging.

Referring now to FIG. 1, which depicts a perspective view of an preferred embodiment of the portable thermoelectric cooling and heating appliance device 10 showing a generally rectangular box 12, a hinge 36, a generally rectangular lid 38, a locking means 46, and a power cord 48. The box 12 is shown having a top, sides, an outer shell 16, and a handle 54. The lid 38 is shown dimensioned to substantially fit over the top of the box 12, in which the lid 38 is pivotally attached to the box 12. The handle 54 is shown attached to the outer shell 16 of the box 12. The lid 38 is shown pivoted over the top of the box 12 then the device 10 is in a closed position. The locking means is shown locking together the lid 38 to the box 12, in which a first portion of the locking means 46 is shown attached to the box 12, and a second portion of the locking means 46 is shown attached to the lid 38. The power cord 48 is shown having a first socket end 50 and a second socket end 52, in which the first socket end 50 is operationally connectable to the power inlet plug 22 of the box 12, and the second socket end 52 is operationally connectable to a standard cigarette lighter power output in an automobile.

Figure 2:
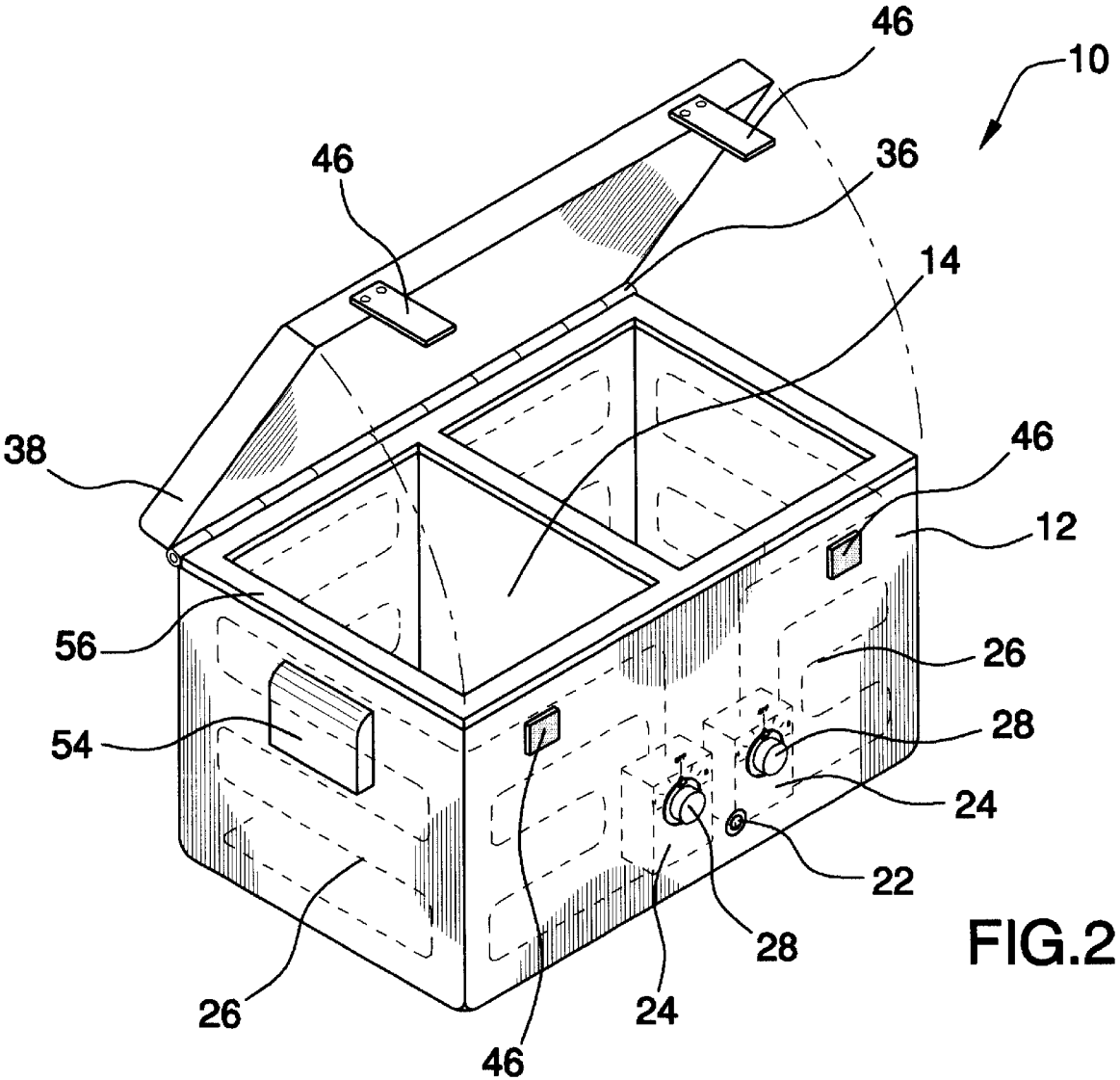
FIG. 2 is a view of a preferred embodiment of the portable thermoelectric cooling and heating appliance device in the open position of the present invention.

Referring now to FIG. 2, which depicts a view of a preferred embodiment of the portable thermoelectric cooling and heating appliance device 10 showing a box 12, a hinge 36, a lid 38, and a locking means 46. The box 12 is shown having a top, four sides, a handle 54, and a divider wall 14, in which the divider wall 14 is shown defining a partition between a left and a right chamber of the box 12. The box 12 is shown having a power input plug 22; a first heat transfer unit 24 attached to the left chamber of the box 12; a first network of cooling/heating coils 26 attached to the left chamber of the box 12; a first control knob 28 having a first voltage regulator and a first thermostat operationally connected to each other, in which the first control knob 28 is shown attached to the left chamber of the box 12, wherein the first control knob 28 is shown operatively attached to the first heat transfer unit 24; a second heat transfer unit 24 is shown attached to the right chamber of the box 12, in which the second heat transfer unit 24 electrically connected to the power input plug 22; a second network of cooling/heating coils 26 is shown attached to the right chamber of the box 12, in which the second network of cooling/heating coils 26 operatively attached to the second beat transfer unit 24; and a second control knob 28 is shown having a second voltage regulator and a second thermostat operationally connected to each other, in which the second control knob 28 is shown attached to the right chamber of the box 12, the second control knob 28 is shown operatively attached to the second heat transfer unit 24. The handle 54 is shown attached to the outer shell 16 of the box 12. The hinge 36 is shown attached to the outer shell 16 of the box 12. The lid 38 is shown dimensioned to substantially fit over the top of the box 12, in which the lid 38 is attached to the hinge 36, wherein the lid 38 is pivotally attached to the box 12. The lid 38 is shown pivoted away from the top of the box 12 so that the device 10 is placed in an open position. The first portion of the locking means 46 is shown attached to the box 12, and the second portion of the locking means 46 is attached to the lid 38.

Figure 3:
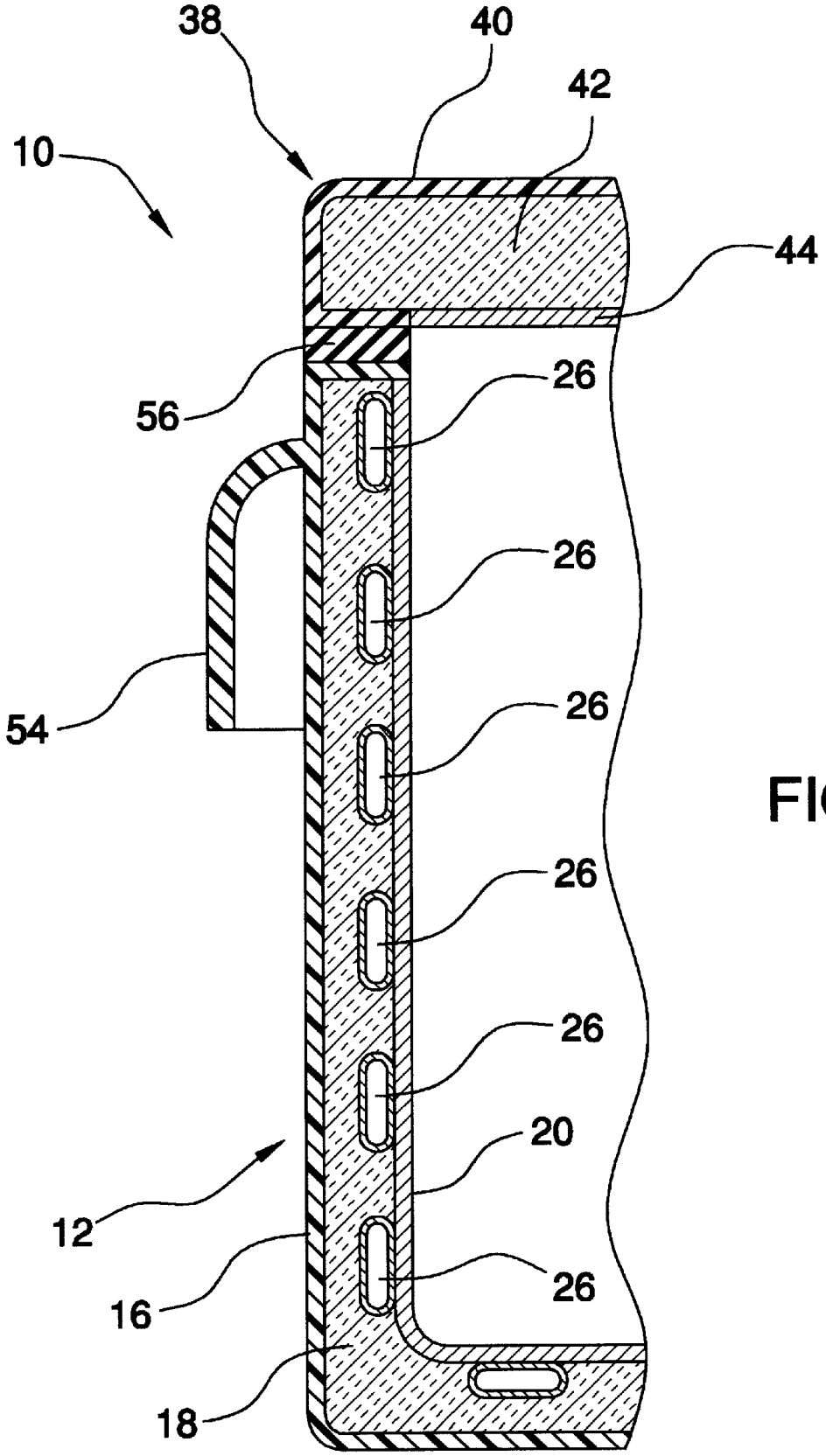
FIG. 3 is a closeup cross sectional front view of a preferred embodiment of the portable thermoelectric cooling and heating appliance device of the present invention.

Referring now to FIG. 3 which depicts a closeup cross sectional front view of a preferred embodiment of the portable thermoelectric cooling and heating appliance device 10 showing a box 12, a rubber gasket 56, a lid 38, and a handle 54. The box 12 is shown having an outer shell 16; an insulation layer 18 attached to the outer shell 16; a inner shell 20 attached to the insulation layer 18. The rubber gasket 56 is shown attached to the top of the box 12. The handle is shown attached to the outer shell 16 of the box 12. A network of cooling/heating coils 26 is attached to the left chamber of the box 12. The lid 38 is shown dimensioned to substantially fit over the top of the box 12, in which the lid 38 is shown over the top of the box 12 over the gasket 56 so that the device 10 is in a closed position. The lid 38 is shown to include: an exterior shell 40; an insulation lining 42 attached to the exterior shell 40 of the lid 38; and an interior shell 44 attached to the insulation lining 42 of the lid 38.

Figure 4:
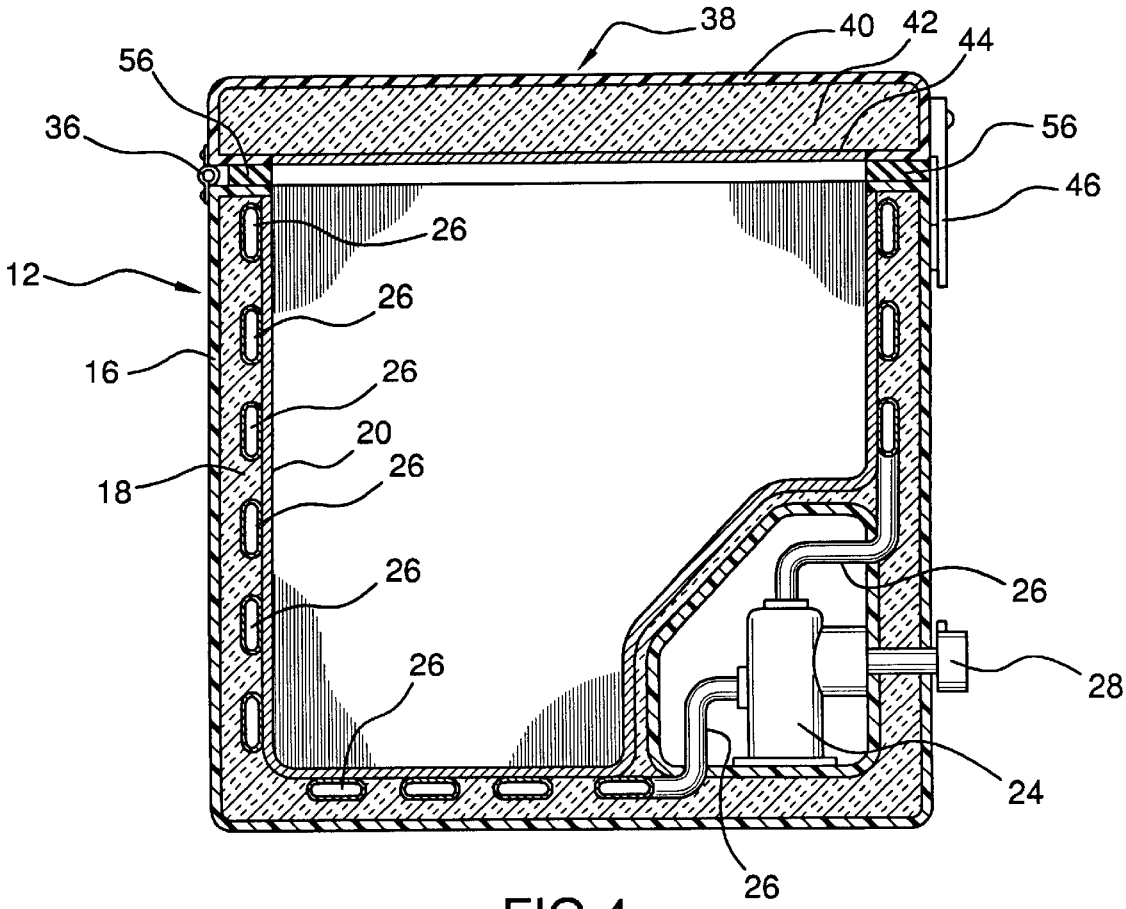
FIG. 4 is a cross sectional side view of a preferred embodiment of the portable thermoelectric cooling and heating appliance device of the present invention.

Referring now to FIG. 4 which depicts a cross sectional side view of a preferred embodiment of the portable thermoelectric cooling and heating appliance device showing a box 12, a hinge 36, a lid 38, a gasket 56, and a locking means 46. The box 12 is shown to include an outer shell 16; an insulation layer 18 attached to the outer shell 16; a inner shell 20 attached to the insulation layer 18; a first heat transfer unit 24 attached to the left chamber of the box 12; a first network of cooling/heating coils 26 is shown attached to the left chamber of the box 12, in which the first network of cooling/heating coils 26 is shown operatively attached to the first heat transfer unit 24; a first control knob 28 is shown having a first voltage regulator and a first thermostat operationally connected to each other, the first control knob 28 is shown attached to the left chamber of the box 12, the first control knob 28 is shown operatively attached to the first heat transfer unit 24. The rubber gasket 56 is shown attached to the top of the box 12. The hinge 36 is shown attached to the outer shell 16 of the box 12. The lid 38 is shown dimensioned to substantially fit over the top of the box 12, in which the lid 38 is shown attached to the hinge 36, wherein the lid 38 is shown pivoted over the top of the box 12 on top of the gasket 56 so that the device 10 is in a sealed closed position. The lid 38 is shown to include: an exterior shell 40; an insulation lining 42 attached to the exterior shell 40 of the lid 38; and an interior shell 44 attached to the insulation lining 42 of the lid 38. The locking means is shown locking together the lid 38 to the box 12, in which a first portion of the locking means 46 is shown attached to the box 12, and a second portion of the locking means 46 is shown attached to the lid 38.

Figure 5:
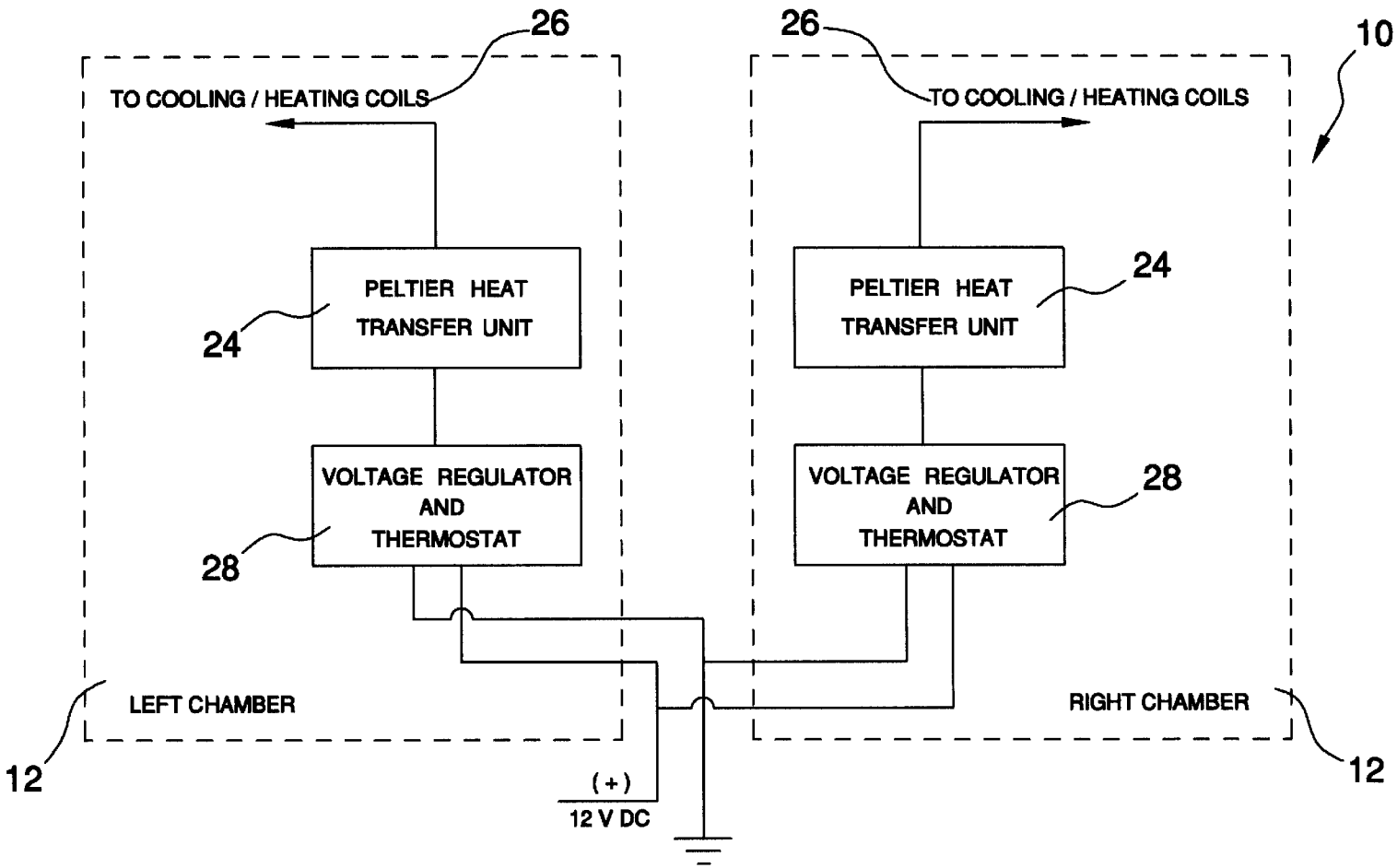
FIG. 5 is an electronic schematic view of a preferred embodiment of the portable thermoelectric cooling and heating appliance device of the present invention.

Referring now to FIG. 5 which depicts an electronic schematic view of a preferred embodiment of the portable thermoelectric cooling and heating appliance device 10 showing a first heat transfer unit 24 attached to the left chamber of the box 12; a first network of cooling/heating coils 26 attached to the left chamber of the box 12, in which the first network of cooling/heating coils 26 is shown operatively attached to the first heat transfer unit 24; a first control knob 28 having a first voltage regulator and a first thermostat is operationally connected to each other, in which the first control knob 28 is shown operatively attached to the first heat transfer unit 24; a second heat transfer unit 24 is shown attached to the right chamber of the box 12; a second network of cooling/heating coils 26 is shown attached to the right chamber of the box 12, in which the second network of cooling/heating coils 26 is shown operatively attached to the second heat transfer unit 24; a second control knob 28 having a second voltage regulator and a second thermostat operationally connected to each other, in which the second control knob 28 is shown attached to the right chamber of the box 12, the second control knob 28 is shown operatively attached to the second heat transfer unit 24.

Figure 6:
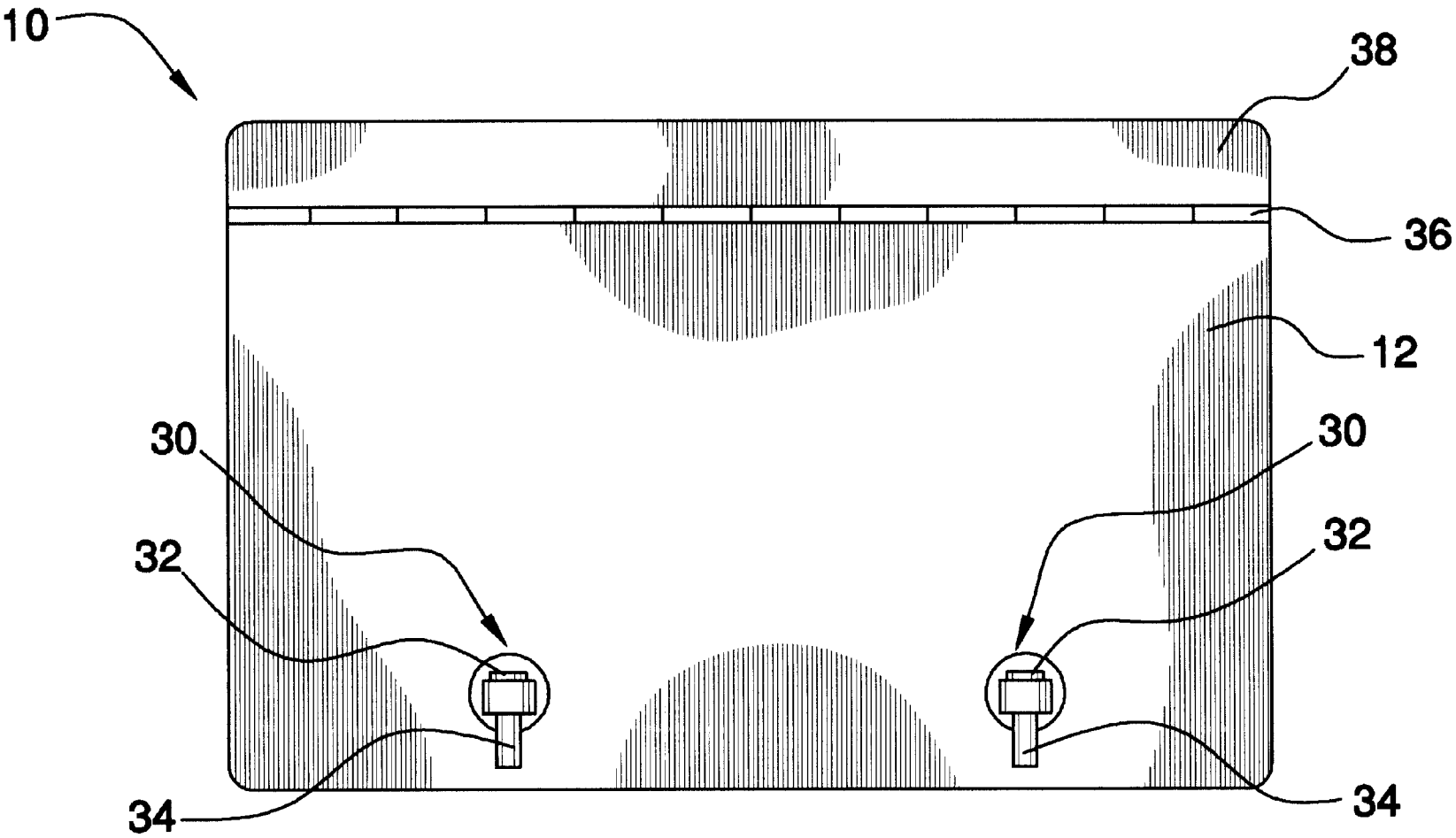
FIG. 6 is a back plan view of a preferred embodiment of the portable thermoelectric cooling and heating appliance device of the present invention.

Referring now to FIG. 6 which depicts a back plan view of a preferred embodiment of the portable thermoelectric cooling and heating appliance device 10 showing a box 12, a hinge 36, and a lid 38. The box 12 is shown including a first spigot 30 and a second spigot 30. The first spigot 30 is shown having a first button 32 and a first drain 34. The second spigot 30 is shown attached to the right chamber of the box 12 and extending outwardly from the box 12. The hinge 36 is shown attached to the outer shell 16 of the box 12. The lid 38 is shown dimensioned to substantially fit over the top of the box 12, in which the lid 38 is shown pivoted over the top of the box 12 then the device 10 is in a closed position.

As to the manner of usage and operation of the present invention, the same should be apparent from the above description. Accordingly, no further discussion relating to the manner of usage and operation will be provided.

While a preferred embodiment of the portable thermoelectric cooling and heating appliance device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable thermoelectric cooling and heating appliance device, said device comprising:

a generally rectangular box having a top, four sides, a bottom and a divider wall, said divider wall defining a partition between a left and a right chamber of said box, said box including:

an outer shell;

an insulation layer attached to said outer shell;

a inner shell attached to said insulation layer;

a power input plug attached to said outer shell;

a first heat transfer unit attached to said left chamber of said box, said first heat transfer unit electrically connected to said power input plug;

a first network of cooling/heating coils attached to said left chamber of said box, said first network of cooling/heating coils operatively attached to said first heat transfer unit;

a first control knob having a first voltage regulator and a first thermostat operationally connected to each other, said first control knob attached to said left chamber of said box, said first control knob operatively attached to said first heat transfer unit;

a first spigot having a first button and a first drain, said first spigot attached to said left chamber of said box and extending outwardly from said box, when said first button of said first spigot is depressed then said first drain is fluidly connected between said left chamber of said box with a surrounding area outside of said device, when said first button is release and not depressed then said first drain is not fluidly connected between said left chamber of said box with the surrounding area outside of said device;

a second heat transfer unit attached to said right chamber of said box, said second heat transfer unit electrically connected to said power input plug;

a second network of cooling/heating coils attached to said right chamber of said box, said second network of cooling/heating coils operatively attached to said second heat transfer unit;

a second control knob having a second voltage regulator and a second thermostat operationally connected to each other, said second control knob attached to said right chamber of said box, said second control knob operatively attached to said second heat transfer unit; and a second spigot having a second button and a second drain, said second spigot attached to said right chamber of said box and extending outwardly from said box, when said second button of said second spigot is depressed then said second drain is fluidly connected between said right chamber of said box with the surrounding area outside of said device, when said second button is release and not depressed then said second drain is not fluidly connected between said right chamber of said box with the surrounding area outside of said device;

a hinge attached to said outer shell of said box;

a generally rectangular lid dimensioned to substantially fit over the top of said box, said lid attached to said hinge, wherein said lid is pivotally attached to said box, when said lid is pivoted over the top of said box then said device is in a closed position, when said lid is pivoted away from the top of said box then said device is in an open position, said lid including:

an exterior shell;

an insulation lining attached to said exterior shell of said lid; and an interior shell attached to said insulation lining of said lid;

a means for locking together said lid to said box, a first portion of said locking means is attached to said box, and a second portion of said locking means is attached to said lid; and a power cord having a first socket end and a second socket end, said first socket end is operationally connectable to said power inlet plug of said box, said second socket end is operationally connectable to a standard cigarette lighter power output in an automobile.

2. The device of claim 1 further comprising a handle attached to said outer shell of said box.

3. The device of claim 1 further comprising a rubber gasket attached to said top of said box.

4. The device of claim 1 wherein said locking means comprises a latch pivotally attached to said exterior shell of said lid; and a coupling pin attached to said outer shell of said box, wherein said latch and said coupling pin are coupleable together, when said box is in the closed position and when said latch is pivoted towards said coupling pin then said locking means is in a locked mode, when said box is in the closed position and when said latch is pivoted away from said coupling pin then said locking means is in an open mode.

5. The device of claim 1 wherein said locking means comprising: a first fabric swath having a first exposed contact surface, said first fabric swath is attached to said exterior shell of said lid; and a second fabric swath having a second exposed contact surface, said second fabric swath is attached to said outer shell of said box, wherein said first exposed contact surface of said first fabric swath and second exposed contact surface of said second fabric swath are interconnectable together, when said box is in the closed position and when said first fabric swath is pivoted towards said second fabric swath so that said first exposed contact surface of said first fabric swath interconnects with said second exposed contact surface of said second fabric swath then said locking means is in a locked mode, when said box is in the closed position and when said first fabric swath is pivoted away from said second fabric swath so that said first exposed contact surface of said first fabric swath does not interconnect with said second exposed contact surface of said second fabric swath then said locking means is in an open mode.

6. The device of claim 5 wherein said first contact surface of said first fabric swath comprises a plurality of minuscule hooks extending outwardly from said first contact surface of said first fabric swath; and wherein said second contact surface of said second fabric swath comprises a plurality of minuscule loops extending outwardly from said second contact surface of said second fabric swath.

7. The device of claim 5 wherein said first contact surface of said first fabric swath comprises a plurality of minuscule loops extending outwardly from said first contact surface of said first fabric swath; and wherein said second contact surface of said second fabric swath comprises a plurality of minuscule hooks extending outwardly from said second contact surface of said second fabric swath.

8. The device of claim 1 wherein said inner shell of said box is made of aluminum.

9. The device of claim 1 wherein said insulation layer of said box is made of foam insulation.

10. The device of claim 1 wherein said outer shell of said box is made of plastic.

11. The device of claim 10 wherein said plastic is selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

12. The device of claim 1 wherein said exterior shell of said lid is made of aluminum.

13. The device of claim 1 wherein said insulation lining of said lid is made of foam insulation.

14. The device of claim 1 wherein said interior shell of said lid is made of plastic.

15. The device of claim 14 wherein said plastic is selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

16. The device of claim 1 wherein said hinge comprises an elongated piano hinge.

17. The device of claim 1 wherein said first heat transfer unit comprises a Peltier heat transfer unit.

18. The device of claim 1 wherein said second heat transfer unit comprises a Peltier heat transfer unit.

19. A portable thermoelectric cooling and heating appliance device, said device consisting essentially of:

a generally rectangular box having a top, four sides, a bottom and a divider wall, said divider wall defining a partition between a first and a right chamber of said box, said box including:

an outer shell, said outer shell of said box is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethanepolymethacryl mixtures, silicone-acryl copolymers, vinyl acetate polymers, and mixtures thereof;

an insulation layer attached to said outer shell, wherein said insulation layer of said box is made of foam insulation;

a inner shell attached to said insulation layer, wherein said inner shell of said box is made of aluminum;

a power input plug attached to said outer shell;

a first heat transfer unit attached to said left chamber of said box, said first heat transfer unit electrically connected to said power input plug, wherein said first heat transfer unit comprises a peltier heat transfer unit;

a first network of cooling/heating coils attached to said left chamber of said box, said first network of cooling/heating coils operatively attached to said first heat transfer unit;

a first control knob having a first voltage regulator and a first thermostat operationally connected to each other, said first control knob attached to said left chamber of said box, said first control knob operatively attached to said first heat transfer unit;

a first spigot having a first button and a first drain, said first spigot attached to said left chamber of said box and extending outwardly from said box, when said first button of said first spigot is depressed then said first drain is fluidly connected between said left chamber of said box with a surrounding area outside of said device, when said first button is release and not depressed then said first drain is not fluidly connected between said left chamber of said box with the surrounding area outside of said device;

a second heat transfer unit attached to said right chamber of said box, said second heat transfer unit electrically connected to said power input plug, wherein said second heat transfer unit comprises a peltier heat transfer unit;

a second network of cooling/heating coils attached to said right chamber of said box, said second network of cooling/heating coils operatively attached to said second heat transfer unit;

a second control knob having a second voltage regulator and a second thermostat operationally connected to each other, said second control knob attached to said right chamber of said box, said second control knob operatively attached to said second heat transfer unit;

a second spigot having a second button and a second drain, said second spigot attached to said right chamber of said box and extending outwardly from said box, when said second button of said second spigot is depressed then said second drain is fluidly connected between said right chamber of said box with the surrounding area outside of said device, when said second button is release and not depressed then said second drain is not fluidly connected between said right chamber of said box with the surrounding area outside of said device; and a handle attached to said outer shell of said box;

a hinge attached to said outer shell of said box, wherein said hinge comprises an elongated piano hinge;

a generally rectangular lid dimensioned to substantially fit over the top of said box, said lid attached to said hinge, wherein said lid is pivotally attached to said box, when said lid is pivoted over the top of said box then said device is in a closed position, when said lid is pivoted away from the top of said box then said device is in an open position, said lid including:

an exterior shell, wherein said exterior shell of said lid is made of aluminum;

an insulation lining attached to said exterior shell of said lid, wherein said insulation lining of said lid is made of foam insulation;

an interior shell attached to said insulation lining of said lid, wherein said interior shell of said lid is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof;

a means for locking together said lid to said box, a first portion of said locking means is attached to said box, and a second portion of said locking means is attached to said lid, wherein said locking means comprising: a first fabric swath having a first exposed contact surface, said first fabric swath is attached to said exterior shell of said lid; and a second fabric swath having a second exposed contact surface, said second fabric swath is attached to said outer shell of said box, wherein said first exposed contact surface of said first fabric swath and second exposed contact surface of said second fabric swath are interconnectable together, when said box is in the closed position and when said first fabric swath is pivoted towards said second fabric swath so that said first exposed contact surface of said first fabric swath interconnects with said second exposed contact surface of said second fabric swath then said locking means is in a locked mode, when said box is in the closed position and when said first fabric swath is pivoted away from said second fabric swath so that said first exposed contact surface of said first fabric swath does not interconnect with said second exposed contact surface of said second fabric swath then said locking means is in an open mode, wherein said first contact surface of said first fabric swath comprises a plurality of minuscule hooks extending outwardly from said first contact surface of said first fabric swath; and wherein said second contact surface of said second fabric swath comprises a plurality of minuscule loops extending outwardly from said second contact surface of said second fabric swath; and a power cord having a first socket end and a second socket end, said first socket end is operationally connectable to said power inlet plug of said box, said second socket end is operationally connectable to a standard cigarette lighter power output in an automobile.

20. A method of using a portable thermoelectric cooling and heating appliance device, said method comprising the steps of:

obtaining the device comprising:

a generally rectangular box having a top, four sides, a bottom and a divider wall, the divider wall defining a partition between a left and a right chamber of the box, the box including:

an outer shell, the outer shell of the box is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof;

an insulation layer attached to the outer shell, wherein the insulation layer of the box is made of foam insulation;

a inner shell attached to the insulation layer, wherein the inner shell of the box is made of aluminum;

a power input plug attached to said outer shell;

a first heat transfer unit attached to the left chamber of the box, the first heat transfer unit electrically connected to the power input plug, wherein the first heat transfer unit comprises a peltier heat transfer unit;

a first network of cooling/heating coils attached to the left chamber of the box, the first network of cooling/heating coils operatively attached to the first heat transfer unit;

a first control knob having a first voltage regulator and a first thermostat operationally connected to each other, said first control knob attached to said left chamber of said box, said first control knob operatively attached to said first heat transfer unit;

a first spigot having a first button and a first drain, the first spigot attached to the left chamber of the box and extending outwardly from the box, when the first button of the first spigot is depressed then the first drain is fluidly connected between the left chamber of the box with a surrounding area outside of the device, when the first button is release and not depressed then the first drain is not fluidly connected between the left chamber of the box with the surrounding area outside of the device;

a second heat transfer unit attached to the right chamber of the box, the second heat transfer unit electrically connected to the power input plug, wherein the second heat transfer unit comprises a peltier heat transfer unit;

a second network of cooling/heating coils attached to the right chamber of the box, the second network of cooling/heating coils operatively attached to the second heat transfer unit;

a second control knob having a second voltage regulator and a second thermostat operationally connected to each other, said second control knob attached to said right chamber of said box, said second control knob operatively attached to said second heat transfer unit;

a second spigot having a second button and a second drain, the second spigot attached to the right chamber of the box and extending outwardly from the box, when the second button of the second spigot is depressed then the second drain is fluidly connected between the right chamber of the box with the surrounding area outside of the device, when the second button is release and not depressed then the second drain is not fluidly connected between the right chamber of the box with the surrounding area outside of the device; and a handle attached to the outer shell of the box;

a hinge attached to the outer shell of the box, wherein the hinge comprises an elongated piano hinge;

a generally rectangular lid dimensioned to substantially fit over the top of the box, the lid attached to the hinge, wherein the lid is pivotally attached to the box, when the lid is pivoted over the top of the box then the device is in a closed position, when the lid is pivoted away from the top of the box then the device is in an open position, the lid including:

an exterior shell, wherein the exterior shell of the lid is made of aluminum;

an insulation lining attached to the exterior shell of the lid, wherein the insulation lining of the lid is made of foam insulation; and an interior shell attached to the insulation lining of the lid, wherein the interior shell of the lid is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof;

a means for locking together the lid to the box, a first portion of the locking means is attached to the box, and a second portion of the locking means is attached to the lid, wherein the locking means comprising: a first fabric swath having a first exposed contact surface, the first fabric swath is attached to the exterior shell of the lid; and a second fabric swath having a second exposed contact surface, the second fabric swath is attached to the outer shell of the box, wherein the first exposed contact surface of the first fabric swath and second exposed contact surface of the second fabric swath are interconnectable together, when the box is in the closed position and when the first fabric swath is pivoted towards the second fabric swath so that the first exposed contact surface of the first fabric swath interconnects with the second exposed contact surface of the second fabric swath then the locking means is in a locked mode, when the box is in the closed position and when the first fabric swath is pivoted away from the second fabric swath so that the first exposed contact surface of the first fabric swath does not interconnect with the second exposed contact surface of the second fabric swath then the locking means is in an open mode, wherein the first contact surface of the first fabric swath comprises a plurality of minuscule hooks extending outwardly from the first contact surface of the first fabric swath; and wherein the second contact surface of the second fabric swath comprises a plurality of minuscule loops extending outwardly from the second contact surface of the second fabric swath; and a power cord having a first socket end and a second socket end, the first socket end is operationally connectable to the power inlet plug of the box, the second socket end is operationally connectable to a standard cigarette lighter power output in an automobile;

positioning the device into an area in the automobile;

adjoining the second socket end of the power cord into the standard cigarette lighter power outlet in the automobile;

affixing the first socket end of the power cord into the power input plug of the device;

pulling pivotally upwards the first fabric swatch so that the first exposed contact surface of the first fabric swath does not interconnect with the second exposed contact surface of the second fabric swath whereby the placing the locking means is in the open mode;

raising pivotally the lid away from the top of the box when the locking means is in the open mode, whereby placing the device in the open position;

placing a sandwich into the left chamber of the device when the device is in the open position;

inserting a can of carbonated soda into the right chamber of the device when the device is in the open position;

closing pivotally the lid onto the top of the box, whereby placing the device in the closed position;

lowering pivotally downwards the first fabric swatch so that the first exposed contact surface of the first fabric swath interconnects with the second exposed contact surface of the second fabric swath when the device is in the closed position, whereby placing the locking means is in the closed mode;

turning the first control knob to enable the first heat transfer unit to warm up the left chamber of the device when the sandwich is placed in the left chamber of the device;

setting the second control knob to enable the second heat transfer unit to cool the right chamber of the device;

allowing the placed sandwich to warm up;

removing the warmed up sandwich from the left chamber of the device;

letting the inserted can of carbonated soda cool down;

grabbing the cooled down can of carbonated soda from the right chamber of the device;

disconnecting the second socket end of the power cord from the standard cigarette lighter power outlet in the automobile;

unplugging the first socket end of the power cord from the power input plug of the device; taking the device away from the automobile;

pressing downwardly onto the first button of the first spigot so that the first drain is fluidly connected between the left chamber of the box with the surrounding area outside of the device, and pushing downwardly onto the second button of the second spigot so that the second drain is fluidly connected between the right chamber of the box with the surrouding area outside of the device.

* * * * *